US008833223B1

(12) United States Patent
Do et al.

(10) Patent No.: US 8,833,223 B1
(45) Date of Patent: Sep. 16, 2014

(54) MULTI-PETAL PROJECTILE ADAPTER FOR A DEARMER

(75) Inventors: Hau T. Do, Lake Hopatcong, NJ (US); Brent Donahue, Newton, NJ (US); Peter Chiu, New York, NY (US); Kevin Russell, Jersey City, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 163 days.

(21) Appl. No.: 13/526,813

(22) Filed: Jun. 19, 2012

(51) Int. Cl.
*F42B 33/00* (2006.01)

(52) U.S. Cl.
USPC ..... 86/50; 102/521

(58) Field of Classification Search
USPC ..... 86/50; 102/703, 521, 522, 523
See application file for complete search history.

(56) References Cited

U.S. PATENT DOCUMENTS

| | | | | |
|---|---|---|---|---|
| 4,590,862 | A * | 5/1986 | Grabarek et al. | 102/522 |
| 4,779,511 | A | 10/1988 | Proctor et al. | |
| 4,957,027 | A | 9/1990 | Cherry | |
| 5,443,011 | A * | 8/1995 | Coates et al. | 102/522 |
| 6,490,957 | B1 | 12/2002 | Alexander et al. | |
| 6,546,838 | B2 * | 4/2003 | Zavitsanos et al. | 89/1.13 |
| 7,047,862 | B1 | 5/2006 | Davis et al. | |
| 2003/0047062 | A1 | 3/2003 | Alexander et al. | |
| 2009/0178548 | A1 | 7/2009 | Tyas et al. | |

* cited by examiner

*Primary Examiner* — Daniel J Troy
(74) *Attorney, Agent, or Firm* — Michael C. Sachs

(57) ABSTRACT

A multi-petal adapter that enables projectiles of different sizes to be used in a single dearmer. The adapter includes a plurality of petals that are secured, in a detachable way, to a base. The main function of the base is to secure the petals until the projectile is fired from the dearmer. Whereupon, the adapter will start petalling until the petals become detached from the base, so that the adapter imparts minimal or no energy or damage to the intended target. The adapter fully regulates the energy imparted to the various projectiles, by allowing propellant gases to bleed through channels that are formed between the petals. As a result, the present adapter fully supports a proper projectile launch and ensures its proper orientation toward the target.

6 Claims, 9 Drawing Sheets

MULTI-PETAL PROJECTILE ADAPTER FOR A DEARMER

GOVERNMENTAL INTEREST

The invention described herein may be manufactured and used by, or for the Government of the United States for governmental purposes without the payment of any royalties thereon.

FIELD OF THE INVENTION

The present invention relates in general to the field of devices for disarming bombs and ordnance. In particular, the present invention relates to an adapter that enables projectiles of different sizes to be used in a single dearmer.

BACKGROUND OF THE INVENTION

One technique for rendering an explosive ordnance device safe is to de-arm that device by rendering its fuze mechanism inoperative. This can be accomplished by destroying or damaging that fuze mechanism so that its firing pin will not be able to contact the detonator device. In this manner, the detonator will not set off the warhead of the ordnance device. De-arming an explosive ordnance in this manner requires the propulsion of a fuze destroying device against the fuze, with enough power to sufficiently damage the fuze and render it inoperative.

This result is generally accomplished by firing a projectile (or a slug) from a dearmer aimed, for example, at the fuze of the target, with enough velocity to impact a portion of the fuze extending out over the ordnance case. This impact bends the whole fuze body rendering the firing pin movement impossible, or in some cases, actually decapitating a portion of the ordnance item.

FIGS. 1, 2, and 3, illustrate a conventional de-arming device (or dearmer) 10 that includes a tubular body 12. A cartridge case 14 containing a propellant charge, and a projectile (or slug) 16 are housed within the body 12. A breech 18 is secured to the aft end of the body 12, in order to lock the cartridge case 14 in position. The propellant charge is set off by a primer and propels the projectile 16 out of the body 12 at a velocity characteristic of that propellant charge.

Currently available dearmers (de-armers or disrupters) are designed to be exclusively used with projectiles of predetermined sizes. As more clearly illustrated in FIGS. 1 and 3, the projectile 16 fits into a matching bore in the dearmer body 12. This limitation poses a serious logistics concern to the soldiers in the field, in that they are currently forced to use several dearmers that are dimensioned for different projectiles.

What is therefore needed is an adapter that enables projectiles of different sizes to be used in a single dearmer. The adapter should allow the dearmer to impart the appropriate amount of energy to the various projectiles, in order to propel them along the properly orientation. Furthermore, the adapter should guide the projectile toward the target. However, the adapter itself should not impart significant energy or damage to the target. Prior to the advent of the present invention, the need for such an adapter has heretofore remained unsatisfied.

SUMMARY OF THE INVENTION

The present invention satisfies this need, and describes a multi-petal adapter for use in conjunction with a dearmer. The adapter enables projectiles of different sizes to be used in a single dearmer. The adapter includes a plurality of petals that are secured, in a detachable way, to a base.

The main function of the base is to secure the petals until the projectile is fired from the dearmer. Whereupon, the adapter will start petalling until the petals become detached from the base, so that the adapter imparts minimal or no energy or damage to the intended target.

The adapter fully regulates the energy imparted to the various projectiles, by allowing propellant gases to bleed through channels that are formed between the petals. As a result, the present adapter fully supports a proper projectile launch and ensures its proper orientation toward the target.

BRIEF DESCRIPTION OF THE DRAWINGS

The above and other features of the present invention and the manner of attaining them, will become apparent, and the invention itself will be best understood, by reference to the following description and the accompanying drawings, wherein:

FIG. 10 is a partly cut-away, isometric view of the dearmer of

FIGS. 4, 8, and 9, shown in position for firing toward a target;

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 4:
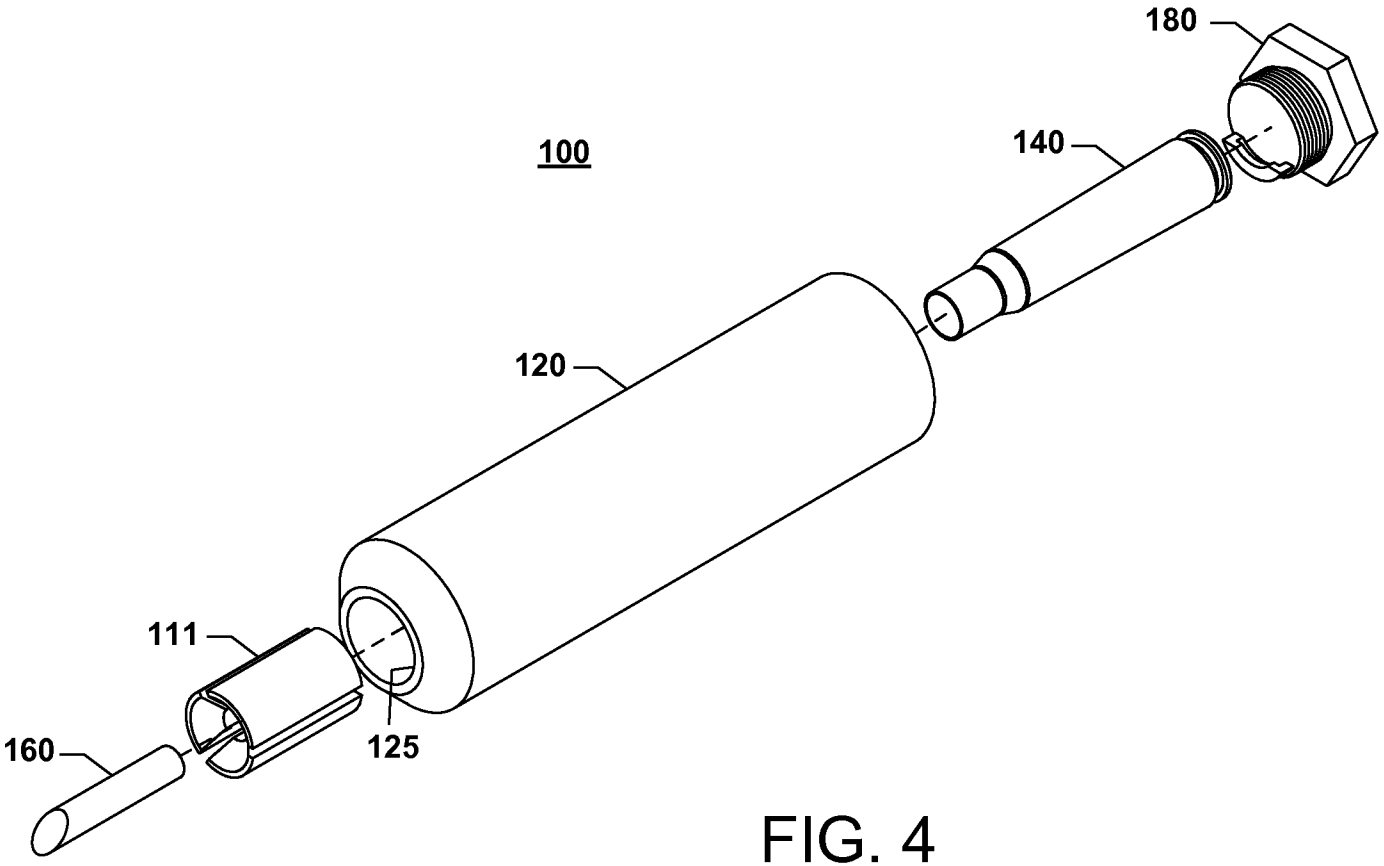
FIG. 4 is an isometric, exploded view of a dearmer according to the present invention, showing an adapter for accommodating a smaller size projectile.

A dearmer 100 of the present invention and its methods of assembly and use will now be described with reference to FIGS. 4 through 12. FIG. 4 shows the dearmer 100 as being generally comprised of a tubular body 120 that is open at both its forward end 125 and its aft end 124.

In this particular example, which is shown for illustration purpose only, it is desired to use a projectile (or slug) 160 having a ⅜-inch outer diameter, in a larger size body 120 with a 1-inch inner diameter forward bore 125. It is further desired to use a cartridge case 140 of a uniform caliber that can be used to propel projectiles 160 of different sizes, without compromising the efficiency of the dearmer 100.

The cartridge case 140 is inserted into a rearward bore 840 inside the body 120, through the aft end 124, and is then threadably locked in position with a breech 180. The projectile 160 is fitted into a multi-petal adapter 111, and the projectile (160)/adapter (111) assembly is then inserted into the body 120, through the forward end 122.

Considering now the adapter 111 in greater detail with respect to FIGS. 5A through 7, FIG. 5 illustrates the adapter 111 as being formed of a plurality of petals, wherefore the name "multi-petal adapter." In this particular illustration, the adapter 111 comprises three identical petals 501, 502, 503. It should however be understood that a different number of petals may be used, and that these petals may differ in shape, depending on the intended application.

The petals 501, 502, 503, are secured at their aft ends to a base 555. While in this particular example, the base 555 is shown as being cylindrically shaped, it should be clear that the dimensions and shape of the base 555 may vary. In the present illustration, the outer diameter of the base 555 is approximately 0.415 inch, and its height is approximately 0.125 inch.

Figure 12:
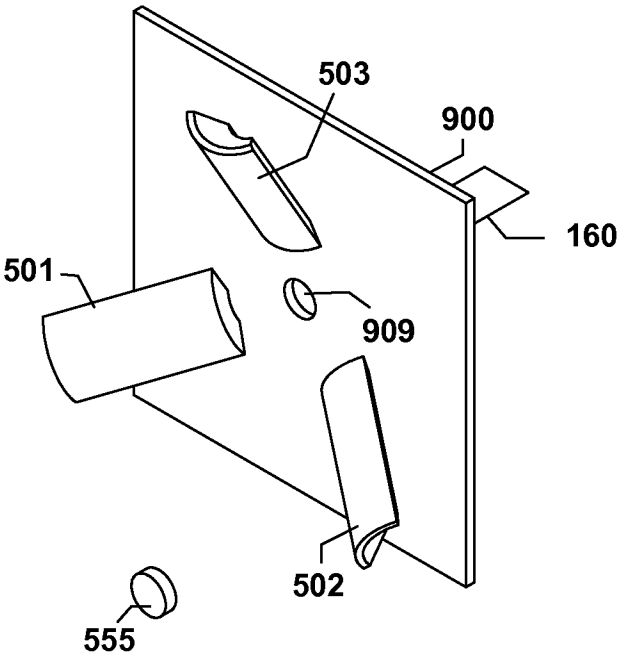
FIG. 12 is a partly cut-away, isometric view of the dearmer of FIG. 11 upon impact with the target, and illustrating the destruction of the adapter and the penetration of a projectile through the target.
Figure 12:
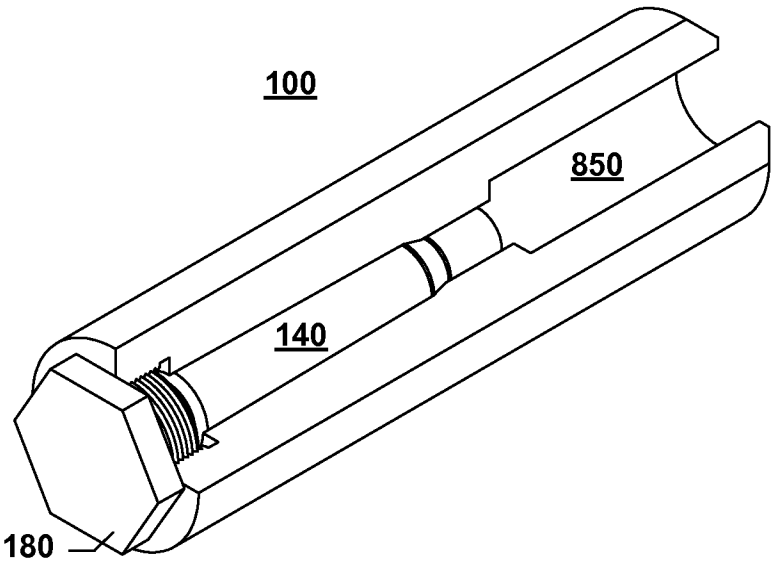

The main function of the base 555 is to secure the three petals 501, 502, 503, until the projectile 160 is fired from the dearmer 100 or until the projectile 160 impacts a target 900 (FIG. 12). Upon firing, the adapter 111 will start petalling until at least some of (or all) the three petals 501, 502, 503 become detached from the base 555, so that the adapter 111 imparts minimal or no energy (or effect) to the intended target 900 (FIG. 12).

An important feature of the adapter 111 is to allow some propellant gases to bleed (or escape) through the adapter 111, upon firing of the cartridge case 140, in order to control the energy imparted onto the projectile 160 (via the adapter 111). To achieve this goal, the three petals 501, 502, 503 are separated by three axial gas escape channels 511, 512, 513, so that the adjacent petals (e.g., 501, 502) are separated by a channel (e.g., 511). In the present illustration, the width of each channel is constant along its entire length and is approximately 0.125 inch.

Figure 5A:
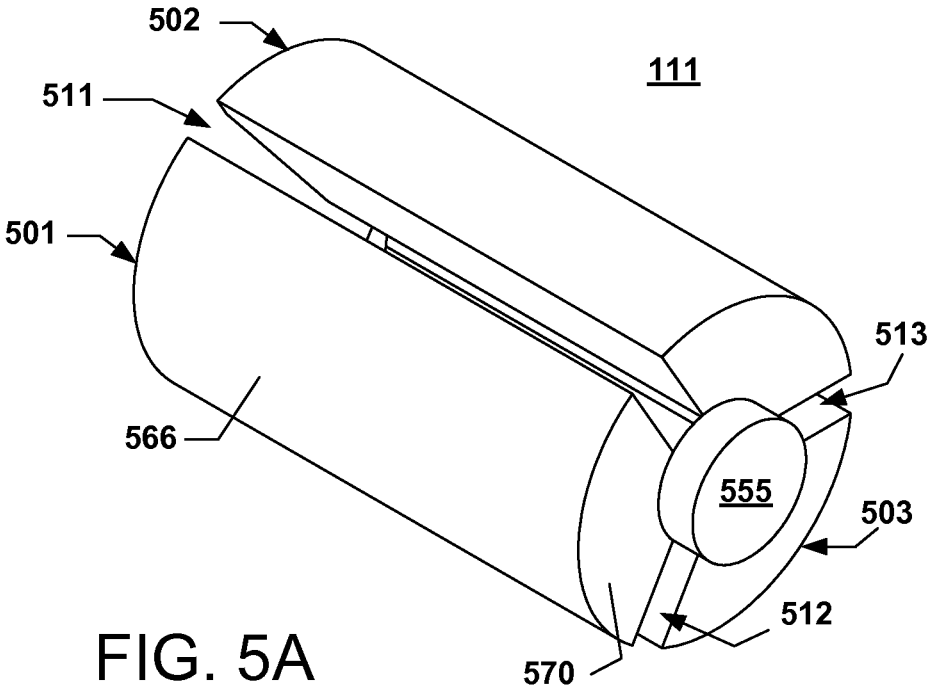
FIG. 5A is an isometric view of the adapter of FIG. 4, which includes three petals.
Figure 5B:
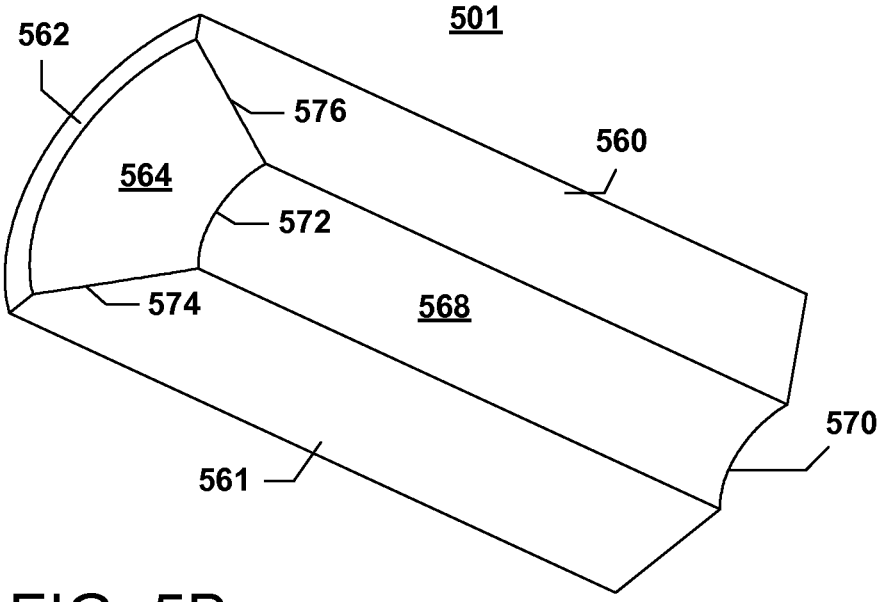
FIG. 5B is an enlarged, isometric view of a representative petal of FIG. 5A.
Figure 6:
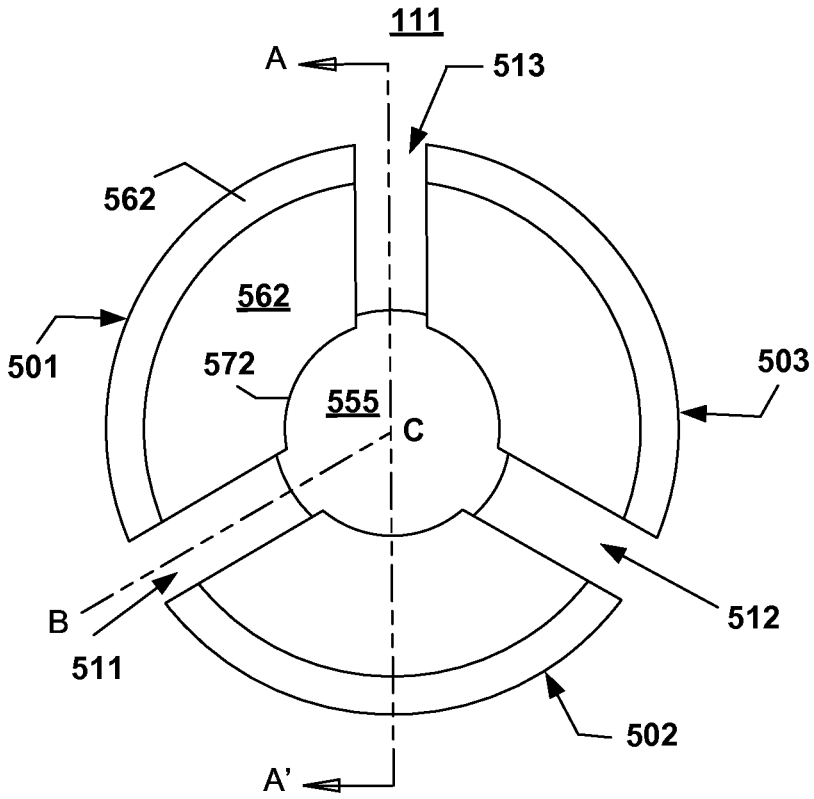
FIG. 6 is an enlarged, top view of the adapter of FIG. 4.

Considering now an exemplary design of the representative petal 501, in connection with FIGS. 5A, 5B, 6 and 7. The petal 501 includes a flat, arcuate front edge 562 having a width of approximately 0.0625 inch. The outer arc of the arcuate front edge 562 defines, in combination with the corresponding arcuate front edges of the other two petals 502, 503, and the gas escape channels 511, 512, 513, the outer diameter of the adapter 111. In this respect, every two adjacent channels, e.g., 501, 502, form an angle of 120°, as represented by the central angle ACB (FIG. 6).

The petal 501 further includes two generally similar, flat external sides 560 and 561 that extend from the arcuate front edge 562 to a flat bottom edge 570 (FIGS. 5A, 5B). The external sides 560, 561, along with the corresponding external sides of the other two petals 502, 503, define the gas escape channels 511, 512, 513. In this illustration, the length of each external side 560, 561, is approximately 1.750 inches.

The arcuate front edge 562 extends internally, downwardly, toward the bottom edge 570, into a flared flange 564 that is defined by two sides 574, 576, and that terminates in an internal arcuate edge 572. The angle of inclination, a, between the arcuate front edge 562 and each side 574, 576 is approximately 45°.

Figure 8:
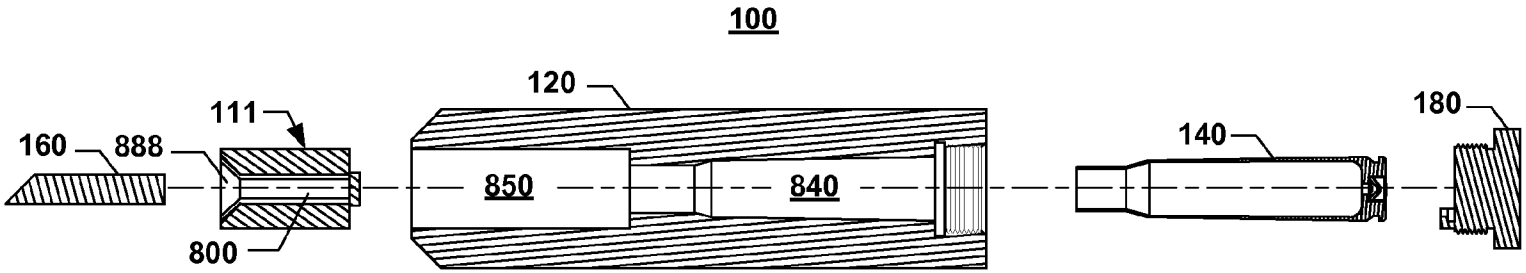
FIG. 8 is a cross-sectional view of the conventional dearmer of FIG. 7.
Figure 9:
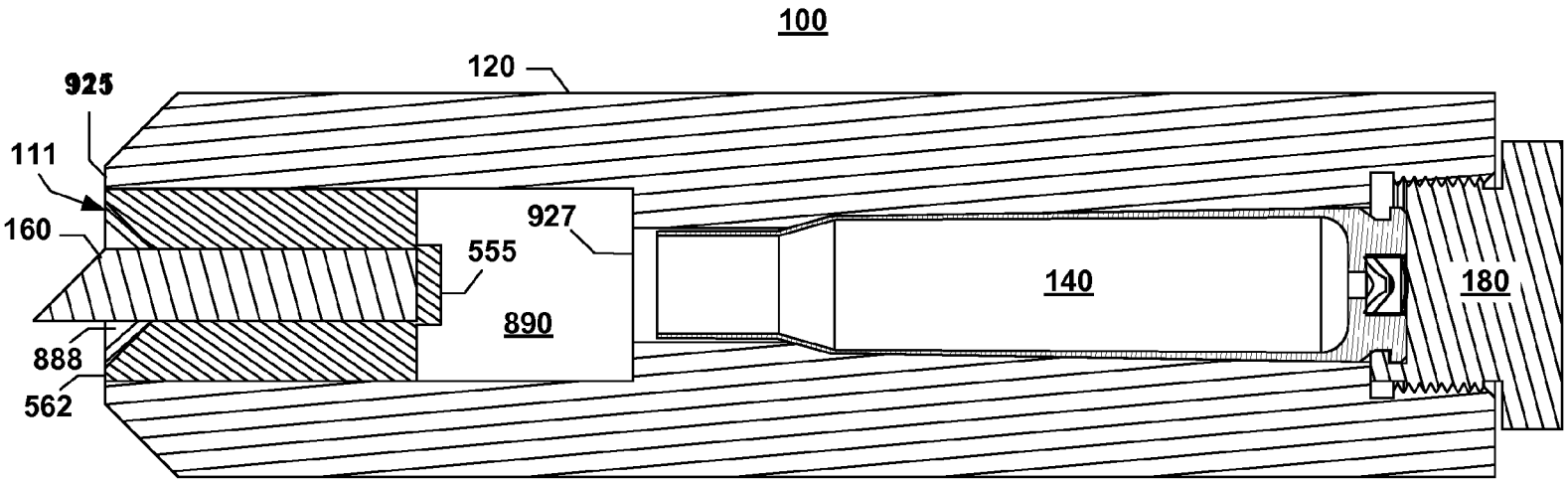
FIG. 9 is an enlarged, cross-sectional view of the assembled dearmer of FIGS. 4 and 8.

As further illustrated in FIGS. 8 and 9, the flared flange 564, along with the corresponding flanges of the other two petals 502, 503, define a generally conical funnel 888. The funnel 888 assists in the petalling of the adapter 111, as it will be explained later in more detail.

The internal arcuate edge 572 defines, in combination with the corresponding internal arcuate edges of the other two petals 502, 503, and the gas escape channels 511, 512, 513, the inner diameter of the adapter 111. In this illustration, the inner diameter of the adapter 111 is approximately 0.375 inch, in order to accommodate the ⅜-inch outer diameter projectile 160.

The two external sides 560, 561 and the flared flange 572 extend internally, into an arcuately shaped, bore section 568. The bore section 568 along with the bore sections of the other two petals 502, 503, form an inner chamber 800 (FIG. 8) for receiving the projectile 160.

In a preferred embodiment, the adapter 111 is made of heat and pressure resistant material, such as polymers. It should however be understood that other suitable material may alternatively be used.

Figure 7:
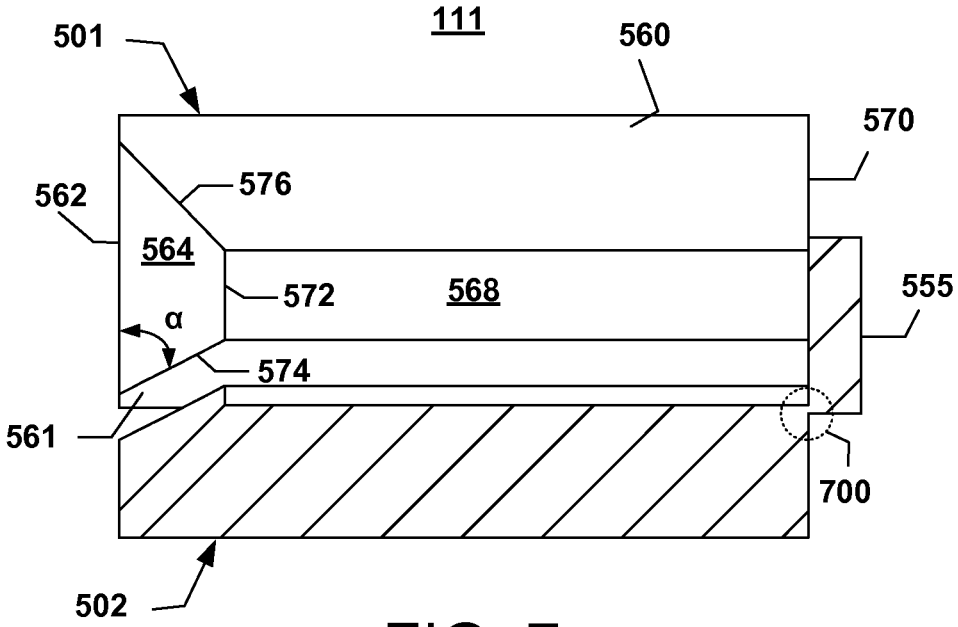
FIG. 7 is an enlarged, cross-sectional, side view of the adapter of FIG. 5, taken along line A-A'.

The adapter 111 may be made as an integral unit, by machining or molding. With reference to FIG. 7, the representative petal 502 is shown to be integrally made with the base 555, and forms a attachment section 700 therewith. This attachment section 700 provides a secure, but weakened connection between each petal and the base 555, in order to ensure the petalling and thus the destruction of the adapter 111, prior to the penetration of the projectile 160 through the target 900 (FIG. 12).

The assembly of the adapter 111 within the dearmer 100 will now be described in connection with FIGS. 8 and 9. The dearmer 100 is assembled for use by inserting the projectile 160 within the bore 800 of the adapter 111. The adapter 111 that houses the projectile 160, is then inserted into a cavity (or bore) 850 that is formed in the forward end of the body 120, so that the arcuate front edge 562 of the adapter 111, is substantially flush with a forward tip 925 of the body 120.

Figure 1:
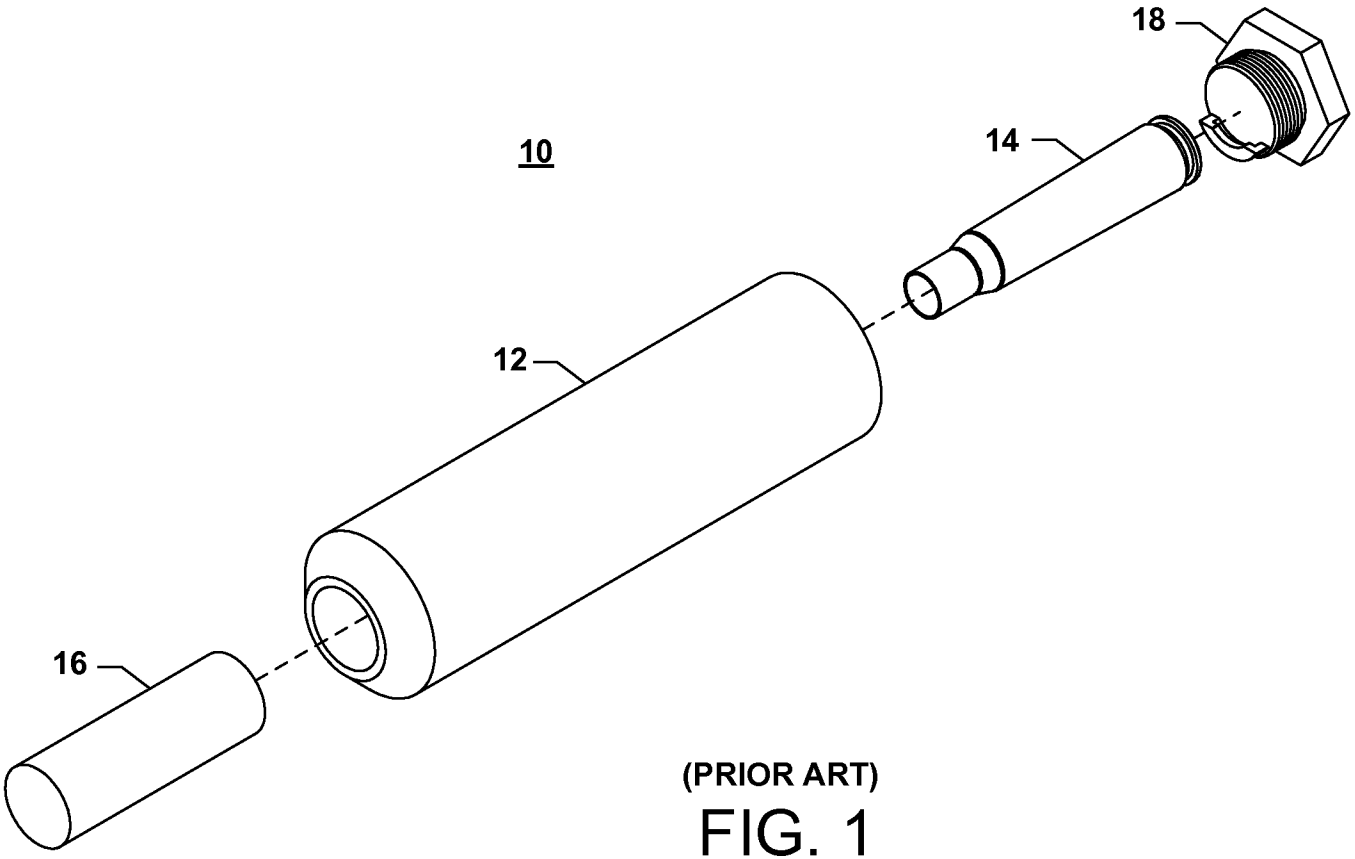
(PRIOR ART) FIG. 1
FIG. 1 is an isometric, exploded view of a conventional dearmer.
Figure 2:
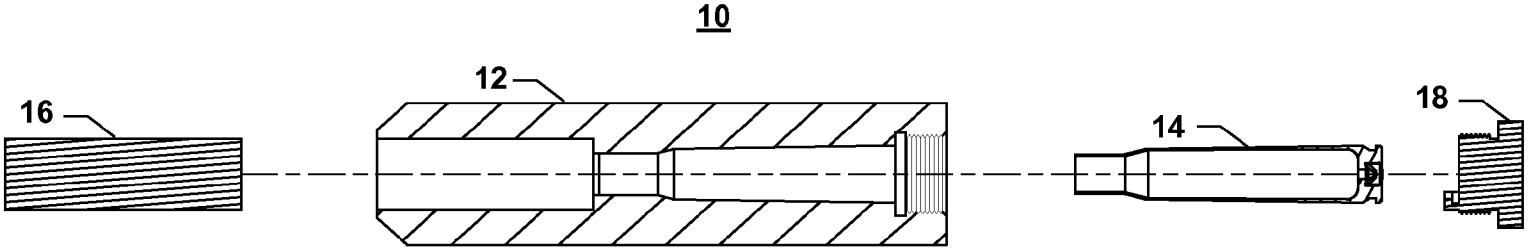
(PRIOR ART) FIG. 2
FIG. 2 is a cross-sectional view of the conventional dearmer of FIG. 1.
Figure 3:
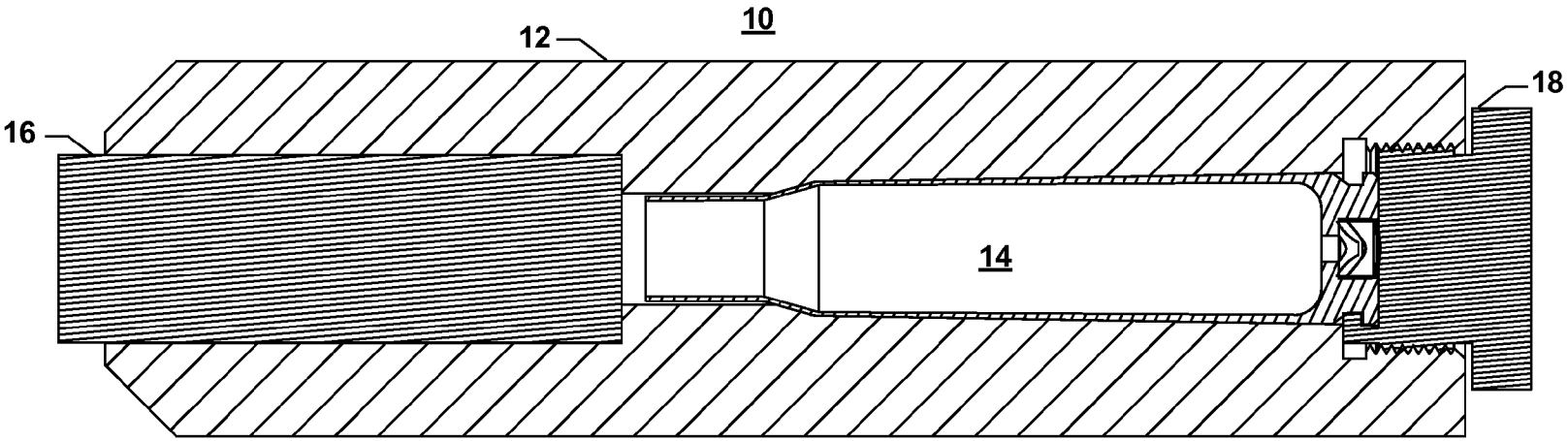
(PRIOR ART) FIG. 3
FIG. 3, is an enlarged, cross-sectional view of the assembled conventional dearmer of FIGS. 1 and 2.

In this position, and as illustrated in FIG. 9, the adapter 111 does not extend to the rear end 927 of the cavity 850, because the projectile 160 is smaller than a projectile for which the bore 800 was dimensioned (e.g., compared to the slug 16 which fills the entire cavity of the body 12 in FIG. 3).

When the projectile (160)/adapter (111) assembly is secured within the body 120, the adapter 111 defines an internal energy release chamber 890 within the cavity 850. One of the functions of the energy release chamber 890, in combination with the channels 511, 512, 513, is to reduce the pressure behind the adapter 111, in order to further control the exit velocity of the adapter 111 and consequently that of the projectile 160.

By manually reducing or expanding the volume of the energy release chamber 890, the user is capable of regulating the amount of energy imparted to the projectile 160. As an example, if the projectile 160 has much smaller dimensions than the projectile for which the bore 800 was dimensioned, the energy required to propel the projectile 160 would need to be minimized. The volume of the energy release chamber 890 is controlled by the seating position of the adapter 111 in the body 120. As a result, the user has the option to either expand or reduce the volume of the energy release chamber 890 by changing the seating position of the adapter 111. This provides a controllable degree of adjustment of the chamber volume which affects the exit velocity of the projectile (160)/adapter (111) assembly.

Figure 10:
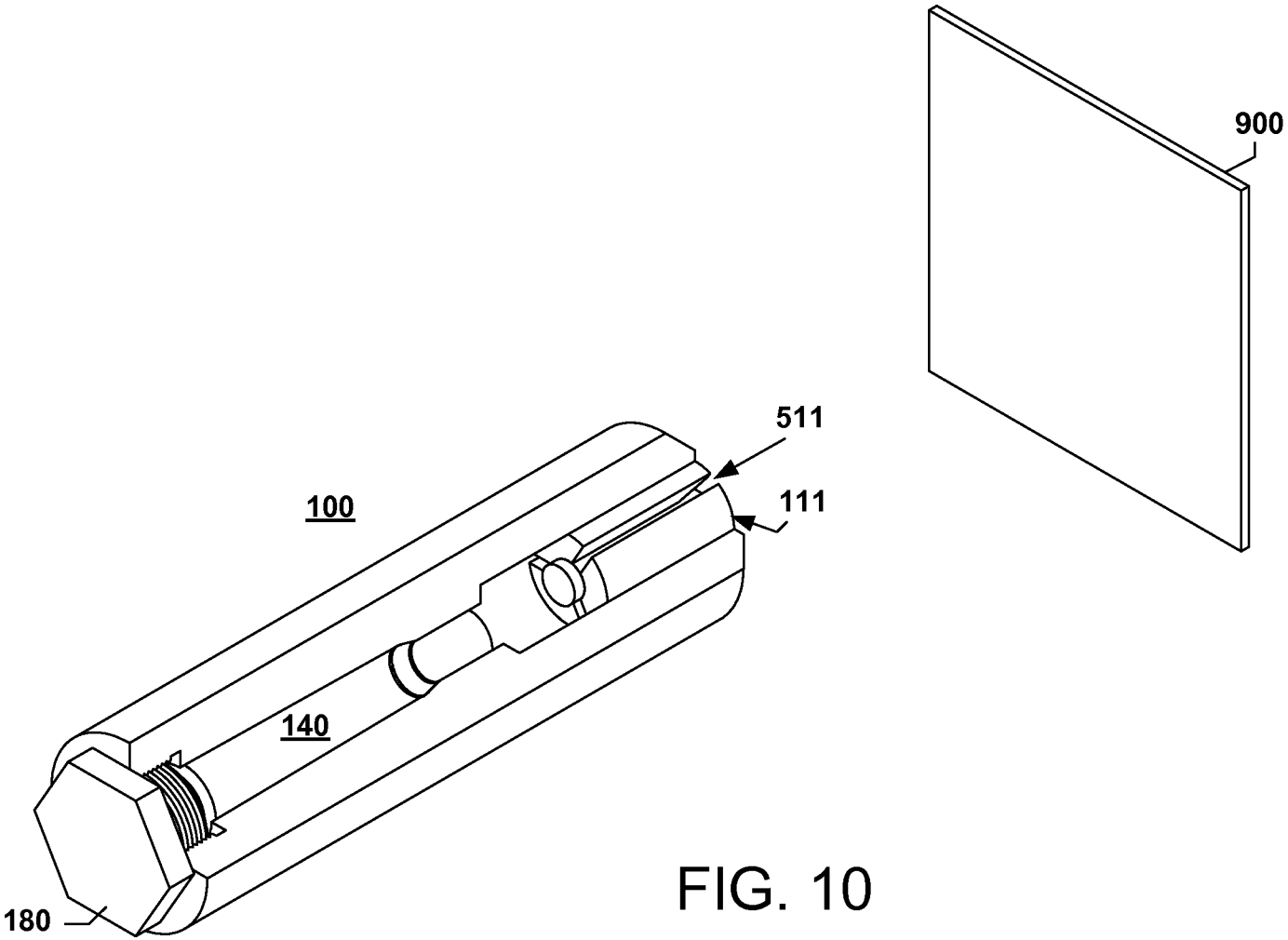

The operation or use of the dearmer 100 of the present invention, will now be described with further reference to FIGS. 10, 11, and 12. FIG. 10 illustrates the dearmer 100 as being assembled and positioned for firing toward the target 900.

Figure 11:
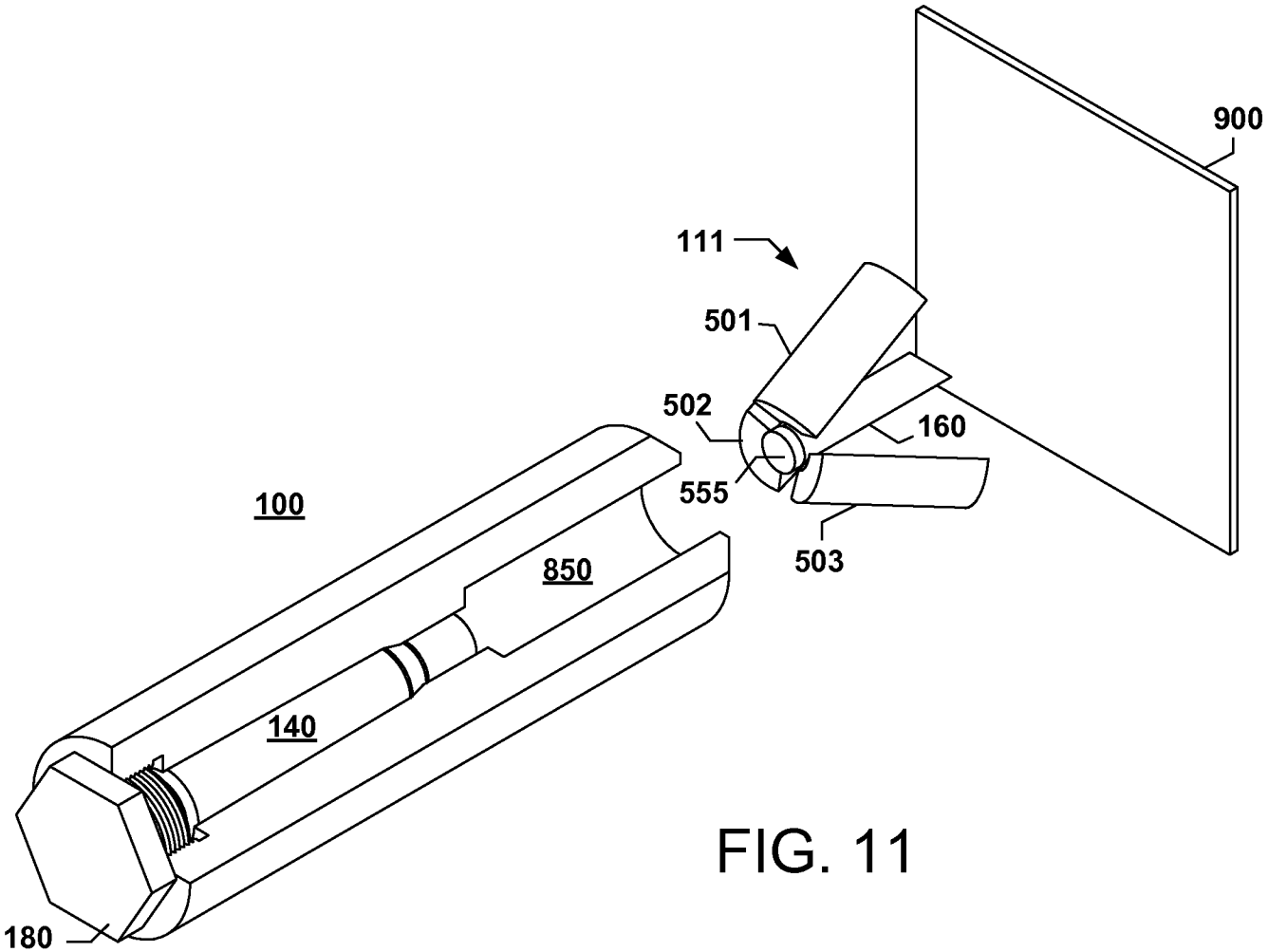
FIG. 11 is a partly cut-away, isometric view of the dearmer of FIG. 10 after firing, and illustrating the petalling of the adapter.

FIG. 11 is an exemplary view of the dearmer 100 FIG. 10 after firing. The channels 511, 512, 513 allow a certain amount of propellant gases to bleed therethrough, in order to regulate the exit velocity of the projectile (160)/adapter (111) assembly.

FIG. 11 further illustrates the petalling of the adapter 111. As used herein, the term "petalling" refers to the spreading out radially, in flight, of the petals 501, 502, 503. Petalling is initiated by the expulsion of the projectile (160)/adapter (111) assembly, whereupon, the funnel 888 (FIG. 9)

In a preferred embodiment, when the air contacts the funnel 888, the petals 501, 502, 503 start to pivot outwardly, about the 700, until the time of impact of the projectile 160 with the target 900. It is possible that during flight, some or all the petals 501, 502, 503 become detached from the base 555; however, in the preferred embodiment, it the impact shock causes all the petals 501, 502, 503 that have not already broken away from the base 555 during flight, to separate therefrom at the attachment section 700.

FIG. 12 shows the dearmer 100 at approximately the moment impact with the target 900, and illustrating the destruction of the adapter 111 and the penetration of the projectile 160 through the target 900. As a result, only the projectile 160 substantially penetrates or damages the target 900.

In the present embodiment, the bore 850 of the body 120 is smooth, and the petals 501, 502, 503 are designed with corresponding smooth outer surfaces. It should however be clear that, in order to accommodate rifled bores, rifling grooves could be cut into the petals 501, 502, 503 of the adapter 111. These grooves, when used in a rifled disruptor or dearmer 100, will impart spin to the adapter 111 and slug 160 during flight.

Although the present safety dearmer 100 has been described in connection with one exemplary application, it should be clear that the dearmer 100 may have multiple commercial applications, including but not limited to law enforcement.

What is claimed is:

1. An adapter for use in a dearmer for accommodating a projectile, wherein the dearmer includes a body having a forward bore of a predetermined inner diameter and a rearward bore for housing a cartridge case, and wherein an outer diameter of the projectile is smaller than the predetermined inner diameter of the forward bore, the adapter comprising:

a plurality of petals that are detachably secured to a base via an attachment section;

wherein, the plurality of petals form an inner chamber that is dimensioned to accommodate the projectile;

wherein the forward bore is dimensioned to accommodate the plurality of petals and the base;

wherein, an expulsion of the adapter from the body causes the petals to start petalling by pivoting outwardly about the attachment section; and wherein upon impact with a target, at least some of the petals become disconnected from the base in order to prevent the petals and the base from having substantial effect on the target and, wherein the plurality of petals are separated by a plurality of axial gas escape channels, in order to allow a propellant gas to bleed therethrough, in order to control the energy imparted onto the adapter.

2. The adapter according to claim 1, wherein at least some of the plurality of axial gas escape channels are identical in shape.

3. The adapter according to claim 1, wherein the plurality of axial gas escape channels are not identical in shape.

4. The adapter according to claim 1, wherein upon insertion of the adapter inside the forward bore, an internal energy release chamber is defined within the forward bore; and wherein the energy release chamber in combination with the axial gas escape channels cause a pressure reduction of the propellant gas acting on the adapter, in order to control an exit velocity of the projectile.

5. The adapter according to claim 4, wherein the internal energy release chamber defines a variable volume that permits an adjustment of the energy imparted to the adapter.

6. The adapter according to claim 5, wherein the variable volume is adjustable by varying a seating position of the adapter within the body.

* * * * *